US007244104B2

(12) United States Patent
Girgis et al.

(10) Patent No.: US 7,244,104 B2
(45) Date of Patent: Jul. 17, 2007

(54) DEFLECTORS FOR CONTROLLING ENTRY OF FLUID LEAKAGE INTO THE WORKING FLUID FLOWPATH OF A GAS TURBINE ENGINE

(75) Inventors: Sami Girgis, Montréal (CA); Remo Marini, Montréal (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 8 days.

(21) Appl. No.: 11/139,629

(22) Filed: May 31, 2005

(65) Prior Publication Data

US 2006/0269399 A1 Nov. 30, 2006

(51) Int. Cl.
*F01D 11/00* (2006.01)

(52) U.S. Cl. ..... 416/193 A; 415/116; 415/168.1; 415/208.1

(58) Field of Classification Search ..... 416/95, 416/193 A, 219 R, 239, 248; 415/115, 116, 415/168.1, 168.2, 168.4, 208.1, 208.2, 208.5
See application file for complete search history.

(56) References Cited

U.S. PATENT DOCUMENTS

| | | | | |
|---|---|---|---|---|
| 2,406,499 | A | 8/1946 | Jandasek | |
| 2,650,752 | A | 9/1953 | Hoadley | |
| 2,735,612 | A | 2/1956 | Hausmann | |
| 2,920,864 | A | 1/1960 | Lee | |
| 2,951,340 | A | 9/1960 | Howald | |
| 2,988,325 | A | 6/1961 | Dawson | |
| 2,990,107 | A | 6/1961 | Edwards | |
| 3,039,736 | A | 6/1962 | Pon | |
| 3,193,185 | A | 7/1965 | Erwin et al. | |
| 3,481,531 | A | 12/1969 | MacArthur et al. | |
| 3,578,264 | A | 5/1971 | Kuethe | |
| 3,602,605 | A | 8/1971 | Lee et al. | |
| 3,756,740 | A * | 9/1973 | Deich et al. | 415/173.7 |
| 3,768,921 | A | 10/1973 | Brown et al. | |
| 3,936,215 | A | 2/1976 | Hoff | |
| 3,990,812 | A | 11/1976 | Radtke | |
| 4,076,454 | A | 2/1978 | Wennerstrom | |
| 4,135,857 | A | 1/1979 | Pannone et al. | |
| 4,222,703 | A | 9/1980 | Schaum et al. | |
| 4,348,157 | A | 9/1982 | Campbell et al. | |
| 4,420,288 | A | 12/1983 | Bischoff | |
| 4,590,759 | A | 5/1986 | Blizzard | |
| 4,624,104 | A | 11/1986 | Stroem | |
| 4,640,091 | A | 2/1987 | Blizzard | |
| 4,674,955 | A | 6/1987 | Howe et al. | |
| 4,708,588 | A | 11/1987 | Schwarz et al. | |
| 4,712,980 | A | 12/1987 | Gely et al. | |
| 4,720,235 | A | 1/1988 | Lachance et al. | |
| 4,844,695 | A | 7/1989 | Banks et al. | |
| 5,211,533 | A | 5/1993 | Walker et al. | |
| 5,215,439 | A | 6/1993 | Jansen et al. | |
| 5,230,603 | A | 7/1993 | Day | |
| 5,846,055 | A | 12/1998 | Brodersen et al. | |
| 6,077,035 | A | 6/2000 | Walters et al. | |
| 6,413,045 | B1 | 7/2002 | Dancer et al. | |
| 6,595,741 | B2 | 7/2003 | Briesenick et al. | |
| 6,672,832 | B2 | 1/2004 | Leeke et al. | |
| 2004/0265118 | A1 * | 12/2004 | Naik et al. | 415/116 |

* cited by examiner

*Primary Examiner*—Richard A. Edgar
(74) *Attorney, Agent, or Firm*—Ogilvy Renault

(57) ABSTRACT

A deflector arrangement is provided for improving turbine efficiency by imparting added tangential velocity to a leakage flow entering the working fluid flowpath of a gas turbine engine.

20 Claims, 5 Drawing Sheets

DEFLECTORS FOR CONTROLLING ENTRY OF FLUID LEAKAGE INTO THE WORKING FLUID FLOWPATH OF A GAS TURBINE ENGINE

TECHNICAL FIELD

The invention relates generally to a deflector for redirecting a fluid flow exiting a leakage path and entering a gaspath of a gas turbine engine.

BACKGROUND OF THE ART

It is commonly known in the field of gas turbine engines to bleed cooling air derived from the compressor between components subjected to high circumferential and/or thermal forces in operation so as to purge hot gaspath air from the leakage path and to moderate the temperature of the adjacent components. The cooling air passes through the leakage path and is introduced into the main working fluid flowpath of the engine. Such is the case where the leakage path is between a stator and a rotor assembly. In fact, at high rotational speed, the rotor assembly propels the leakage air flow centrifugally much as an impeller.

Such air leakage into the working fluid flowpath of the engine is known to have a significant impact on turbine efficiency. Accordingly, there is a need for controlling leakage air into the working fluid flowpath of gas turbine engines.

SUMMARY OF THE INVENTION

It is therefore an object of this invention to provide a new fluid leakage deflector arrangement which addresses the above-mentioned issues.

In one aspect, the present invention provides a gas turbine engine including a forward stator assembly and a rotor assembly, the rotor assembly drivingly mounted to an engine shaft having an axis, the rotor assembly having a plurality of circumferentially distributed blades that extend radially outwardly into a working fluid flowpath, a leakage path leading to the working fluid flowpath being defined between the stator assembly and the rotor assembly, and an array of deflectors exposed to the flow of leakage fluid and defining a number of discrete inter-deflector passages through which the leakage fluid flows before being discharged into the working fluid flowpath, each of said deflectors having a leading end pointing into the oncoming flow of leakage fluid and a concave surface redirecting the leakage fluid from a first direction to a second direction substantially tangential to a direction of the working fluid.

In another aspect, the present invention provides a rotor blade extending into a working fluid flow path of a gas turbine engine, the rotor blade comprising an airfoil portion extending from a first side of a platform, and an array of deflectors provided on said first side of the platform at a front end portion thereof upstream of said airfoil portion, the deflectors defining a series of inter-deflector passages curving from a first direction to a second direction substantially tangential to the flow of working fluid flowing over said airfoil portion.

In another aspect, the present invention provides a turbine blade for attachment to a rotor disc of a gas turbine engine having an annular gaspath in fluid flow communication with a fluid leakage path, the turbine blade extending radially outwardly from the rotor disc into the annular gaspath; the turbine blade comprising an airfoil portion extending from a first side of a platform and a root portion extending from an opposite second side of the platform, and an array of deflectors provided on a front end of the platform, the deflectors having a first end and a second end, the first end adjacent the leading edge of the platform and the second end extending away from the leading edge towards the airfoil portion, the deflectors having a convex side and a concave side oriented in opposite relation to a concave surface of the airfoil portion, the concave side of the deflectors scooping a fluid flow exiting the leakage path and redirecting the fluid to enter the gaspath in a direction substantially tangential to a direction of the gaspath flow.

In another aspect, the present invention provides a method for improving efficiency of a gas turbine engine, comprising the steps of: channelling a flow of leakage fluid through a leakage path into a working fluid flowpath of the gas turbine engine, and redirecting the leakage fluid to enter the working fluid flowpath in a direction substantially tangential to a direction of the working fluid flow.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
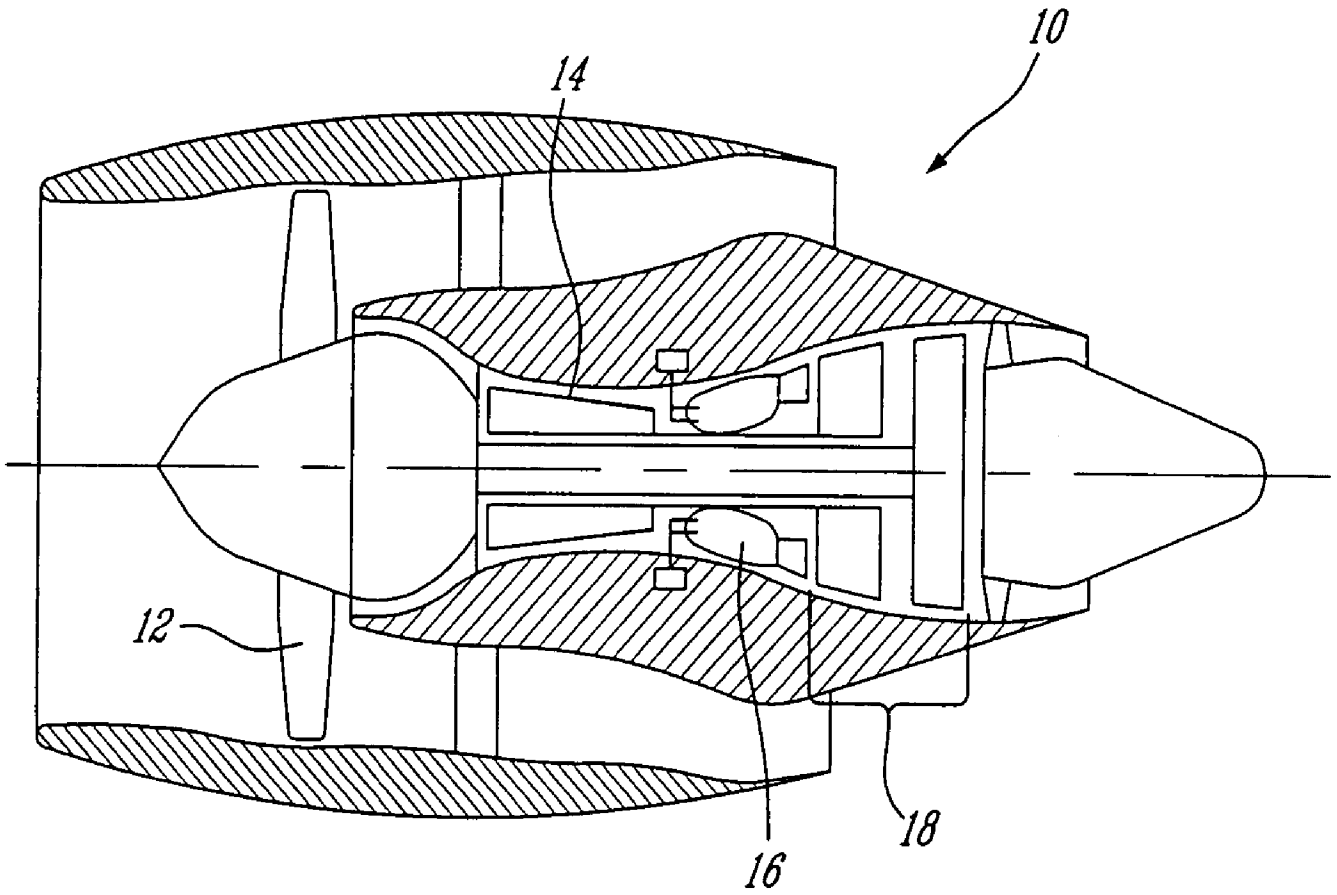
FIG. 1 is a schematic cross-sectional view of a gas turbine engine.

FIG. 1 illustrates a gas turbine engine 10 of a type preferably provided for use in subsonic flight, generally comprising in serial flow communication through a working flow path a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
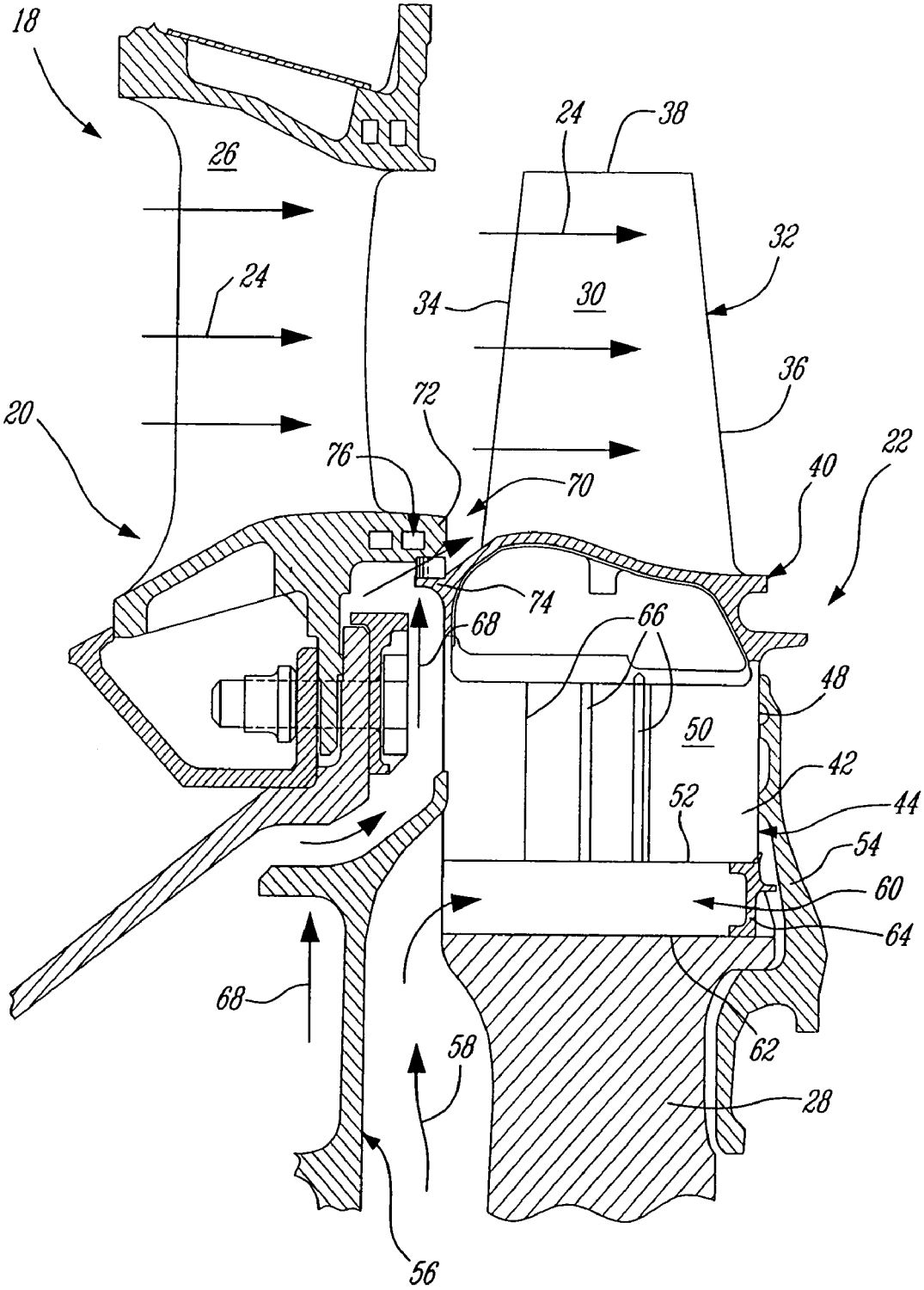
FIG. 2 is an axial cross-sectional view of a portion of a turbine section of the gas turbine engine showing a turbine blade (mounted on a rotor disk) including a deflector arrangement in accordance with an embodiment of the present invention.

FIG. 2 illustrates in further detail the turbine section 18 which comprises among others a forward stator assembly 20 and a rotor assembly 22. A gaspath indicated by arrows 24 for directing the stream of hot combustion gases axially in an annular flow is generally defined by the stator and rotor assemblies 20 and 22 respectively. The stator assembly 20 directs the combustion gases towards the rotor assembly 22 by a plurality of nozzle vanes 26, one of which is depicted in FIG. 2. The rotor assembly 22 includes a disc 28 drivingly mounted to the engine shaft (not shown) linking the turbine section 18 to the compressor 14. The disc 28 carries at its periphery a plurality of circumferentially distributed blades 30 that extend radially outwardly into the annular gaspath 24, one of which is shown in FIG. 2.

Figure 3:
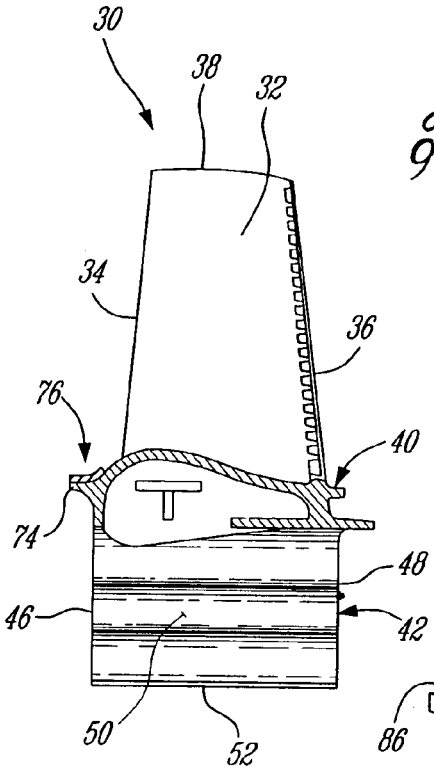
FIG. 3 is a side view of the turbine blade with the deflector arrangement.

Referring concurrently to FIGS. 2 and 3, it can be seen that each blade 30 has an airfoil portion 32 having a leading edge 34, a trailing edge 36 and a tip 38. The airfoil portion 32 extends from a platform 40 provided at the upper end of a root portion 42. The root portion 42 is captively received in a complementary blade attachment slot 44 (FIG. 2) defined in the outer periphery of the disc 28. The root portion 42 is defined by forward and rearward surfaces 46 and 48, two side surfaces 50 and an undersurface 52, and is typically formed in a fir tree configuration that cooperates with mating serrations in the blade attachment slot 44 to resist centrifugal dislodgement of the blade 30. A rearward circumferential shoulder 54 adjacent the rearward surface of the root 42 is used to secure the blades 30 to the rotor disc 28.

Thus, the combustion gases enter the turbine section 18 in a generally axial downstream direction and are redirected at the trailing edges of the vanes 26 at an oblique angle toward the leading edges 34 of the rotating turbine blades 30.

Referring to FIG. 2, the turbine section 18, and more particularly the rotor assembly 22 is cooled by air bled from the compressor 14 (or any other source of coolant). The rotor disc 28 has a forwardly mounted coverplate 56 that covers almost the entire forward surface thereof except a narrow circular band about the radially outward extremity. The coverplate 56 directs the cooling air to flow radially outwards such that it is contained between the coverplate 56 and the rotor disc 28. The cooling air indicated by arrows 58 is directed into an axially extending (relative to the disc axis of rotation) blade cooling entry channel or cavity 60 defined by the undersurface 52 of the root portion 42 and the bottom wall 62 of the slot 44. The channel 60 extends from an entrance opposing a downstream end closed by a rear tab 64. The channel 60 is in fluid flow communication with a blade internal cooling flow path (not shown) including a plurality of axially spaced-apart cooling air passages 66 extending from the root 42 to the tip 38 of the blade 30. The passages 66 lead to a series of orifices (not shown) in the trailing edge 36 of the blade 30 which reintroduce and disperse the cooling air flow into the hot combustion gas flow of the gaspath 24.

Still referring to FIG. 2, a controlled amount of fluid from the cooling air is permitted to re-enter the gaspath 24 via a labyrinth leakage path identified by arrows 68. The leakage path 68 is defined between the forward stator assembly 20 and the rotor assembly 22. More particularly, the fluid progresses through the leakage path until introduced into the gaspath 24 such that it comes into contact with parts of the stator assembly 20, the forward surface of the coverplate 56, the rotor disc 28, the forward surface 46 of the root 42 and the blade platform 40. The fluid flows through the labyrinth leakage path 68 to purge hot combustion gases that may have migrated into the area between the stator and rotor assemblies 20 and 22 which are detrimental to the cooling system. Thus, the leakage fluid creates a seal that prevents the entry of the combustion gases from the gaspath 24 into the leakage path 68. A secondary function of the fluid flowing through the leakage path 68 is to moderate the temperature of adjacent components.

Furthermore, the fluid is introduced into the gaspath 24 by passing through a rearward open nozzle 70 defined by a back end portion of a vane platform 72 and a front end portion 74 of a blade platform 40. A deflector arrangement 76 is included on the front end portion 74 of the blade platform 40 for directing the flow of cooling air to merge smoothly with the flow of hot gaspath air causing minimal disturbance. The deflector arrangement 76 is designed in accordance with the rotational speed of the rotor assembly 22 and the expected fluid flow velocity.

Figure 4:
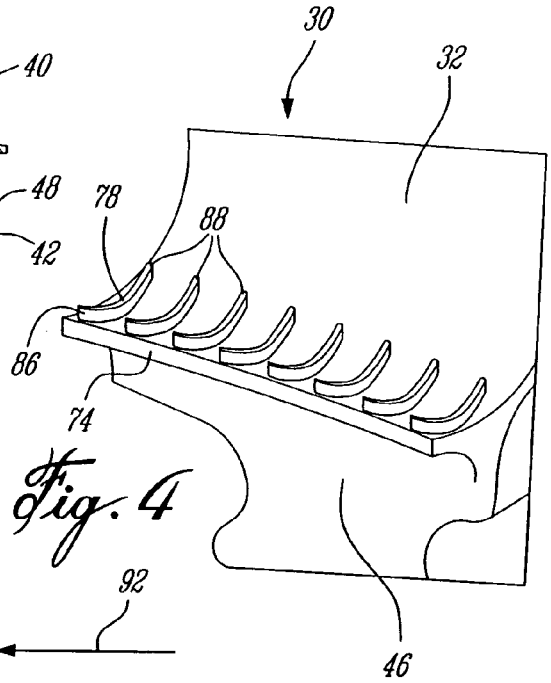
FIG. 4 is a perspective view of an array of deflectors provided on a front end portion of a platform of the turbine blade shown in FIG. 3.
Figure 5:
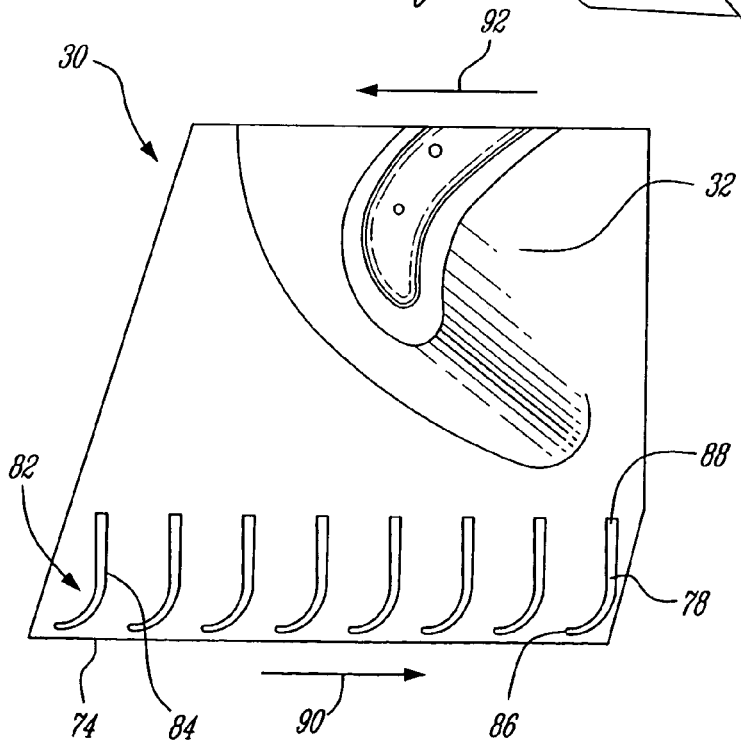
FIG. 5 is a top plan view of the array of deflectors provided on the front end portion of the platform of the turbine blade shown in FIG. 3.

In this exemplary embodiment, the deflector arrangement 76 comprises an array of equidistantly spaced deflectors in series with respect to each other and to the front end portion 74 of the blade platform 40 as depicted in FIGS. 4, 5, 7, and 8. The array of deflectors extends transversally of the blade platform 40. In one embodiment of the present invention, the array of deflectors 76 are provided as aerodynamically shaped winglets 78 extending from the blade platform 40 as shown in FIGS. 3 to 5. More specifically, the winglets 78 extend radially outwards away from the blade platform 40 at a predetermined height and axially away from the front end portion 74 of the blade platform 40. The winglets 78 are located upstream of the airfoils 32 of the blades 30. The array of winglets 78 may be integral to the blade platform 40 or mounted thereon. Preferably, the winglets 78 are identical in shape and size, which will be discussed in detail furtheron.

Figure 6:
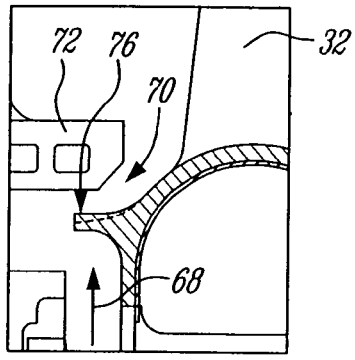
FIG. 6 is a schematic cross-sectional view of a front end portion of a platform of the turbine blade with a deflector arrangement in accordance with another embodiment of the present invention.
Figure 7:
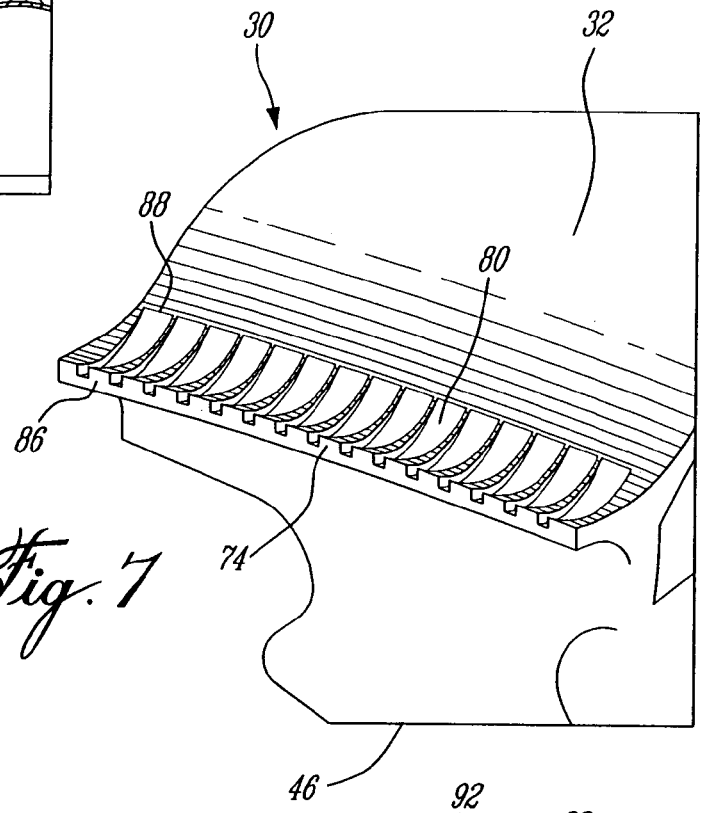
FIG. 7 is a perspective view of an array of deflectors formed in the front end portion of the platform of the turbine blade shown in FIG. 6.
Figure 8:
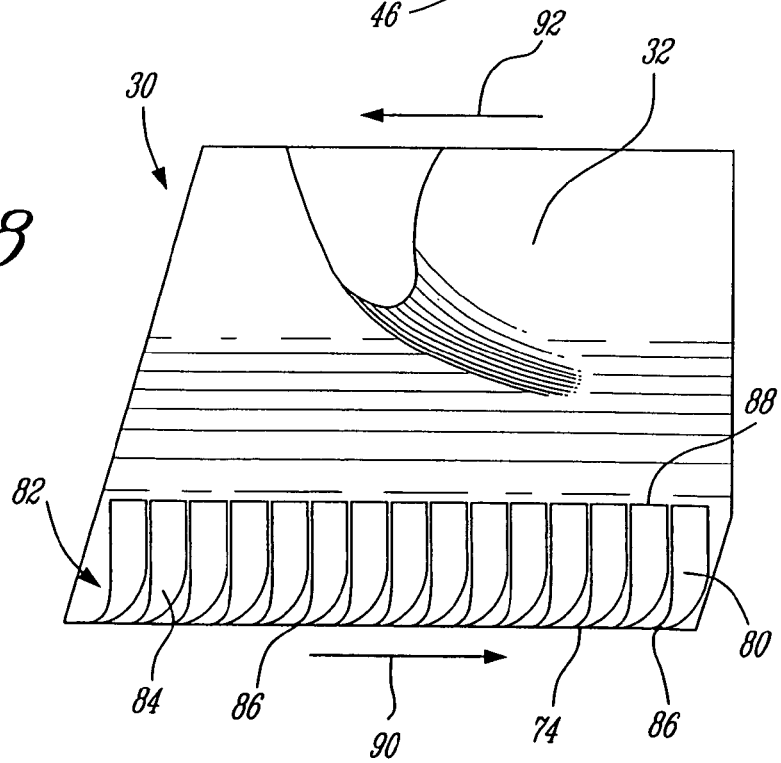
FIG. 8 is a top plan view of the array of deflectors provided in the front end portion of the platform of the turbine blade shown in FIG. 6.

In another embodiment of the present invention, the array of deflectors 76 are provided as aerodynamically shaped lands between adjacent grooves 80 defined in the blade platform 40 as shown in FIGS. 6 to 8. Similar to the winglets 78, the array of grooves 80 are in series along the front end portion 74 of the platform 40 and extend axially away therefrom. Preferably, the grooves 80 are integrally formed with the platform 40 such as by machining or casting. Notably, the depth and axial length of the grooves 80 as shown in FIGS. 6 and 7 may vary. Also, the grooves 80 are preferably identical in shape and size as will be discussed furtheron.

At this point it should be stated that both deflector embodiments described above provide the same functionality and therefore any description to follow applies to both embodiments as well as to any other equivalents. It is to be understood that the deflector 76 may be provided in various shapes and forms and is not limited to an array thereof.

Referring concurrently to FIGS. 5 and 8, each deflector 76 of the array of deflectors has a concave side 82 and a convex side 84 defining a "J" shape profile. Another possible shape for the deflectors is defined by a reverse "C" shape profile. Each deflector 76 extends axially between a first end or a leading edge 86 and a second end or a trailing edge 88 thereof. The leading edges 86 of the deflectors 76 are adjacent to the front edge of the blade platform 40. The concave sides 82 of the array of deflectors 76 are oriented to face the oncoming fluid flow exiting the leakage path 68, the direction of which is indicated by arrows 90. Each deflector 76 has a curved entry portion curving away from the direction of flow of the oncoming leakage air and merging with a generally straight exit portion. The deflectors 76 are thus configured to turn the oncoming leakage air from a first direction to a second direction substantially tangential to the flow of combustion gases flowing over turbine blades 30. The curvature of the deflectors 76 is opposite to that of the airfoils 32 and so disposed to redirect the leakage air onto the airfoils 32 at substantially the same incident angle as that of the working fluid onto the airfoils 32.

Figure 9:
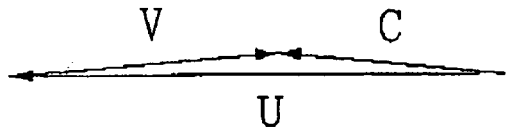
FIG. 9 is a velocity triangle representing the original velocity of a fluid flow exiting a leakage path before being scooped and redirected by a deflector.
Figure 10:
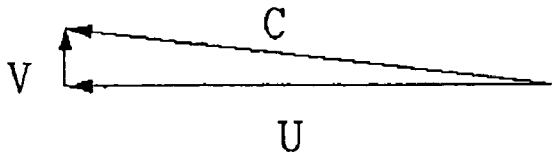
FIGS. 10 and 11 are possible velocity triangles representing the resulting velocity of the fluid flow when scooped and redirected by a deflector.
Figure 11:
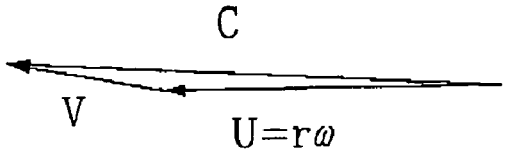

Referring now to FIGS. 9, 10 and 11, the arrows 90 (FIGS. 5 and 8) represent vector V of FIG. 9 which indicates the relative velocity of the fluid flow exiting the leakage path 68. The relative velocity vector V is defined as being relative to the rotating rotor assembly 22, and more particularly relative to the direction and magnitude of blade rotation at the periphery of the rotor disc 28 indicated by vector U and represented by arrows 92 in FIGS. 5 and 8. The absolute velocity of the fluid flow is indicated by vector C and is defined as being relative to a stationary observer. It can be observed from FIG. 9 that the absolute velocity C of the fluid flow exiting the leakage path 68 is less in magnitude than the magnitude of the velocity U of blade rotation. In order to have the absolute fluid flow velocity C substantially equal or greater than the blade rotation velocity U as illustrated in FIGS. 10 and 11, the deflectors 76 are used to scoop the fluid flow and re-direct the flow in a substantially perpendicular or inclined direction to the direction of blade rotation. Thus an observer would see the leakage fluid flowing at the substantially the same or greater speed as the periphery of the rotor disc 28 rotates.

More specifically, the leading edges 86 of the deflectors 76 are pointed in a direction substantially opposite the direction of arrows 90 and in the direction of rotation of the rotor assembly 22 to produce a scooping effect thereby imparting a velocity to the cooling air leakage flow that is tangential to the gaspath flow. Test data indicates that imparting tangential velocity to the leakage air significantly reduces the impact on turbine efficiency. In fact, the scooping effect of the deflectors 76 also causes an increase in fluid momentum which gives rise to the increase in actual magnitude of the fluid flow. The fluid emerges from the deflectors 76 with an increased momentum that better matches the high momentum of the gaspath flow and with a relative direction that substantially matches that of the gaspath flow. As a result, the fluid flow merges with the hot gaspath flow in a more optimal aerodynamic manner thereby reducing inefficiencies caused by colliding air flows. Such improved fluid flow control is advantageous in improving turbine performance.

It would be apparent to a person skilled in the art that the gaspath flow travelling between the stator and rotor assemblies 20 and 22 is not axial and therefore the velocity imparted to the fluid is not completely tangential to the rotor assembly 22 axis of rotation.

The above description is meant to be exemplary only, and one skilled in the art will recognize that changes may be made to the embodiments described without department from the scope of the invention disclosed. For example, the deflectors may extend up to the airfoil of the rotor blade while still imparting tangential velocity and increased momentum to the cooling air flow. The deflectors could be mounted at other locations on the rotor assembly as long as they are exposed to the leakage air in such a way as to impart added tangential velocity thereto. Also, a similar deflector arrangement could be introduced in the compressor section of a gas turbine engine for controlling the flow of air which is reintroduced back into the working flow path of the engine. Furthermore, the deflectors could be mounted on the stator assembly to impart a tangential component to the leakage air before the leakage be discharged into the working fluid flow path or main gaspath of the engine. Still other modifications which fall within the scope of the present invention will be apparent to those skilled in the art, in light of a review of this disclosure, and such modifications are intended to fall within the appended claims.

The invention claimed is:

1. A gas turbine engine including a forward stator assembly and a rotor assembly, the rotor assembly drivingly mounted to an engine shaft having an axis, the rotor assembly having a plurality of circumferentially distributed blades that extend radially outwardly into a working fluid flowpath, a leakage path leading to the working fluid flowpath being defined between the stator assembly and the rotor assembly, and an array of deflectors exposed to the flow of leakage fluid and defining a number of discrete inter-deflector passages through which the leakage fluid flows before being discharged into the working fluid flowpath, each of said deflectors having a leading end pointing into the oncoming flow of leakage fluid and a concave surface redirecting the leakage fluid from a first direction to a second direction substantially tangential to a direction of the working fluid, wherein each of said blades has an airfoil extending from a first side of a platform, and wherein a transversal row of side-by-side grooves is defined in a front end portion of the platform, each pair of adjacent grooves being spaced by a land, the lands forming said defectors.

2. The gas turbine engine as defined in claim 1, wherein said leading end generally points in a direction of rotation of said rotor assembly.

3. The gas turbine engine as defined in claim 1, wherein each of said deflectors has a curved entry portion curving gradually away from a flow direction of said leakage flow, said curved entry portion merging into a substantially straight exit portion.

4. The gas turbine engine as defined in claim 1, wherein the leading end of the deflectors is adjacent the front edge of the platform of the blades.

5. The gas turbine engine as defined in claim 4, wherein the deflectors have a trailing end extending away from the front edge of the platform towards the airfoil and defining a "J" shape profile.

6. The gas turbine engine as defined in claim 4, wherein the deflectors have a trailing end extending away from the front edge of the platform towards the airfoil and defining a reverse "C" shape profile.

7. A rotor blade extending into a working fluid flow path of a gas turbine engine, the rotor blade comprising an airfoil portion extending from a first side of a platform, and an array of deflectors provided on said first side of the platform at a front end portion thereof upstream of said airfoil portion, the deflectors defining a series of inter-deflector passages curving from a first direction to a second direction substantially tangential to the flow of working fluid flowing over said airfoil portion, wherein each of said deflectors has a leading end pointing in a direction of rotation of said rotor blade.

8. The rotor blade as defined in claim 7, wherein each of said deflectors has a concave guiding surface oriented in opposite relation to a concave pressure surface of said airfoil portion.

9. The rotor blade as defined in claim 7, wherein said defectors are arranged side-by-side in a row transversal to said platform.

10. The rotor blade as defined in claim 7, wherein each of said deflectors has a leading end adjacent the front edge of the platform.

11. The rotor blade as defined in claim 10, wherein each of the deflectors has a trailing end extending away from the front edge of the platform towards the airfoil and defining a "J" shape profile.

12. The rotor blade as defined in claim 10, wherein each of the deflectors has a trailing end extending away from the front edge of the platform towards the airfoil and defining a reverse "C" shape profile.

13. The rotor blade as defined in claim 7, wherein the array of deflectors are provided as winglets extending radially outwards from the first side of the platform.

14. The rotor blade as defined in claim 7, wherein a transversal row of side-by-side grooves is defined in the front end portion of the platform, each pair of adjacent grooves being spaced by a land, the lands fanning said deflectors.

15. A turbine blade for attachment to a rotor disc of a gas turbine engine having an annular gaspath in fluid flow communication with a fluid leakage path, the turbine blade extending radially outwardly from the rotor disc into the annular gaspath; the turbine blade comprising an airfoil portion extending from a first side of a platform and a root portion extending from an opposite second side of the platform, and an array of deflectors provided on a front end of the platform, the deflectors having a first end and a second end, the first end adjacent the leading edge of the platform and the second end extending away from the leading edge towards the airfoil portion, the deflectors having a convex side and a concave side oriented in opposite relation to a concave surface of the airfoil portion, the concave side of the deflectors scooping a fluid flow exiting the leakage path and redirecting the fluid to enter the gaspath in a direction substantially tangential to a direction of the gaspath flow.

16. The turbine blade as defined in claim 15, wherein said first end points in a direction of rotation of said turbine blade.

17. The rotor blade as defined claim 15, wherein said deflectors are arranged side-by-side in a row transversal to said platform.

18. A method for improving efficiency of a gas turbine engine, comprising the steps of: a) channelling a flow of leakage fluid through a leakage path into a working fluid flowpath of the gas turbine engine, the leakage path being defined between a row of stator vane and a row of rotor blades, each of said rotor blades having a platform, and b) redirecting the leakage fluid to enter the working fluid flowpath in a direction substantially tangential to a direction of the working fluid flow, wherein step b) comprises channelling the leakage fluid through a series of grooves defined in the platforms of the rotor blades.

19. A rotor blade extending into a working fluid flow path of a gas turbine engine, the rotor blade comprising an airfoil portion extending from a first side of a platform, and an array of deflectors provided on said first side of the platform at a front end portion thereof upstream of said airfoil portion, the deflectors defining a series of inter-deflector passages curving from a first direction to a second direction substantially tangential to the flow of working fluid flowing over said airfoil portion, wherein each of said deflectors has a concave guiding surface oriented in opposite relation to a concave pressure surface of said airfoil portion.

20. A rotor blade extending into a working fluid flow path of a gas turbine engine, the rotor blade comprising an airfoil portion extending from a first side of a platform, and an array of deflectors provided on said first side of the platform at a front end portion thereof upstream of said airfoil portion, the deflectors defining a series of inter-deflector passages curving from a first direction to a second direction substantially tangential to the flow of working fluid flowing over said airfoil portion, wherein a transversal row of side-by-side grooves is defined in the front end portion of the platform, each pair of adjacent grooves being spaced by a land, the lands forming said deflectors.

* * * * *

UNITED STATES PATENT AND TRADEMARK OFFICE

CERTIFICATE OF CORRECTION

PATENT NO. : 7,244,104 B2
APPLICATION NO. : 11/139629
DATED : July 17, 2007
INVENTOR(S) : Sami Girgis and Remo Marini It is certified that error appears in the above-identified patent and that said Letters Patent is hereby corrected as shown below:

In the claim:

Column 7, line 15, delete “fanning” insert --forming--

Signed and Sealed this

Thirtieth Day of October, 2007

JON W. DUDAS
*Director of the United States Patent and Trademark Office*